US007164406B2

(12) United States Patent
Lee

(10) Patent No.: US 7,164,406 B2
(45) Date of Patent: Jan. 16, 2007

(54) METHOD FOR DRIVING LIQUID CRYSTAL DISPLAY

(75) Inventor: Sang Kon Lee, Seoul (KR)

(73) Assignee: Boe-Hydis Technology Co., Ltd., Kyoungki-do (KR)

( * ) Notice: Subject to any disclaimer, the term of this patent is extended or adjusted under 35 U.S.C. 154(b) by 447 days.

(21) Appl. No.: 10/656,575

(22) Filed: Sep. 5, 2003

(65) Prior Publication Data

US 2004/0125059 A1 Jul. 1, 2004

(30) Foreign Application Priority Data

Dec. 31, 2002 (KR) ..... 10-2002-0088266

(51) Int. Cl.
*G09G 3/36* (2006.01)

(52) U.S. Cl. ..... 345/94; 345/95; 345/100

(58) Field of Classification Search ..... 345/98, 345/100, 94–96, 87, 204
See application file for complete search history.

(56) References Cited

U.S. PATENT DOCUMENTS 5,526,012 A * 6/1996 Shibahara ..... 345/92
5,995,074 A * 11/1999 Kusafuka et al. ..... 345/90
6,005,542 A * 12/1999 Yoon ..... 345/92

* cited by examiner

*Primary Examiner*—Regina Liang
(74) *Attorney, Agent, or Firm*—Ladas & Parry LLP

(57) ABSTRACT

Disclosed is a method for driving a liquid crystal display, in which the response speed of a liquid crystal is improved by the change of gate pulse voltage. The method comprises the steps of: sequentially generating a plurality of gate pulse voltages having 1st to 3rd levels while being synchronized with vertical clock signal in said 1 vertical period; in invert driving, dividing the generating period of the plural gate pulse voltages into a charge period, a holding period and a discharge period in respective polar periods corresponding to the 1st to 3rd levels of the plural gate pulse voltage; and converging pixel voltage of the discharge period to a common voltage level, wherein the 3rd level exists in a range between the 1st level and the $2^{nd}$ level.

8 Claims, 5 Drawing Sheets

METHOD FOR DRIVING LIQUID CRYSTAL DISPLAY

BACKGROUND OF THE INVENTION

1. Field of the Invention

The present invention relates to a method for driving a liquid crystal display, and more particularly to a method for driving a liquid crystal display, in which the response speed of a liquid crystal is improved by the change of gate pulse voltage in an Active Matrix Liquid Crystal Display (hereinafter referred to AM-LCD).

2. Description of the Prior Art

As generally known in the art, an AM-LCD is an OA (Office Automation) based product for notebooks or monitors developed for word processing or CAD (Computer-aided design) designing on a freeze frame. Recently, with the development of display devices and an increase of requirements for multimedia environment, a clear moving picture has been required in AM-LCD adapted notebooks and monitors, etc. Also, as a digital broadcast becomes widely spread, the demand for AV (Audiovisual) LCD products has been on the rise.

However, an AM-LCD in the prior art adapts a hold-type driving method for holding displayed data signals for only one field (frame), causing a problem in that a moving picture can not be displayed naturally, unlike an impulsive type CRT (Cathode-ray tube).

For instance, in a case where an AM-LCD is driven at 60 Hz, signals are held for 1/60 second so that, even an liquid crystal with so rapid response speed is used, the signal level is held every 1/60 second, thus transmitting a moving picture which appears choppy.

FIG. 1 is a timing diagram of the conventional AM-LCD according to its driving.

Referring to FIG. 1, in the driving method of the conventional AM-LCD, vertical start signals STV are enabled in 1 vertical period 1V (1V corresponds 16.7 ms when driven at 60 Hz), are synchronized with a transition of vertical clock signal CPV, generating gate pulse voltage, i.e., gate high pulse voltage Vgh and gate low pulse voltage Vgl, thus sequentially scanning the plural gate lines. Herein, V_syn which is not described above represents a vertical synchronous signal, and G1~G768 represent drive signals sequentially applied to from $1^{st}$ gate line to $768^{th}$ gate line.

FIGS. 2A and 2B are waveform diagrams showing properties of pixel charge/discharge of the conventional AM-LCD, which show pixel charge/discharge properties in a positive field and a negative field, respectively.

Referring to FIG. 2A, in the positive field, while gate high pulse voltage Vgh is outputted at a gate drive IC, TFT channels are opened, electric charges supplied through the data lines are introduced into the pixels, charging the corresponding pixels (1H period). Herein, the period on which electric charges are introduced is called a charge period.

Meanwhile, at the gate drive IC, while gate low pulse voltage Vgl is outputted, TFT channels are closed, and applied pixel voltage is reduced by kickback voltage Vp(+), being maintained at a constant level relatively higher than the common voltage Vcom (1V–1H period). Herein, the period over which electric charges are held is called a holding period.

Referring to FIG. 2B, in the negative field, while gate high pulse voltage Vgh is outputted, TFT channels are opened, electric charges flow into the date lines, and the corresponding pixels are discharged. Herein, the period over which electric charges flow is called a discharge period.

Meanwhile, at the gate drive IC, while gate low pulse voltage Vgl is outputted, TFT channels are closed, pixel voltage applied is reduced by kickback voltage Vp(−), maintaining at constant level relatively lower than the common voltage Vcom (1V–1H period). Herein, the period over which electric charges are held at a constant level by discharge of electric charges is a holding period.

The conventional driving method of AM-LCD has a drawback in that operational features of an LCD are mainly generated in the holding period among the periods of charge, discharge and holding so that, since the holding period is held for 1V, a stepping phenomenon is generated when providing moving picture, which makes it difficult to reproduce a smooth moving picture.

Also, the driving method of the conventional AM-LCD holds the holding period of gate pulse voltage for up to the next 1 vertical period after generation of gate pulse voltage, which causes a blurring phenomenon that profiles of picture images are blurred. It has been known that this blurring phenomenon is generated when response time of the liquid crystal is long.

SUMMARY OF THE INVENTION

Accordingly, the present invention has been made to solve the above-mentioned problems occurring in the prior art, and an object of the present invention is to provide a driving method for LCD which reduces a holding period of gate pulse voltage, generates gate pulse voltage of multi-level in which pixel voltage converges the common voltage level so as to drive a liquid crystal, thus providing a smooth moving picture.

In order to accomplish this object, there is provided a method for driving an LCD in which gate lines are sequentially scanned in 1 vertical period, the method comprising the steps of: sequentially generating a plurality of gate pulse voltages having 1st to 3rd levels while being synchronized with vertical clock signal in said 1 vertical period; in invert driving, dividing the generating period of the plural gate pulse voltages into a charge period, a holding period and a discharge period in respective polar periods corresponding to the 1st to 3rd levels of the plural gate pulse voltage; and converging pixel voltage of the discharge period to a common voltage level, wherein the 3rd level exists in a range between the 1st level and the $2^{nd}$ level.

BRIEF DESCRIPTION OF THE DRAWINGS

The above and other objects, features and advantages of the present invention will be more apparent from the following detailed description taken in conjunction with the accompanying drawings, in which.

DETAILED DESCRIPTION OF THE PREFERRED EMBODIMENTS

Figure 1:
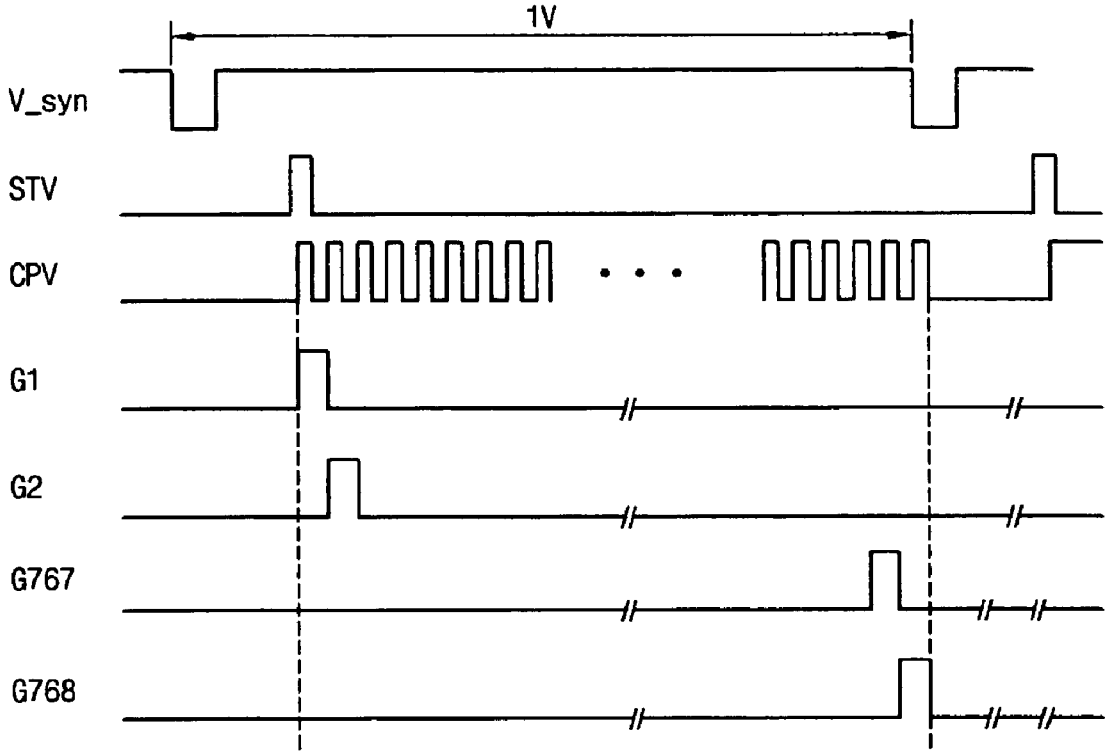
FIG. 1 is a timing diagram of the conventional AM-LCD according to its driving.
Figure 2A:
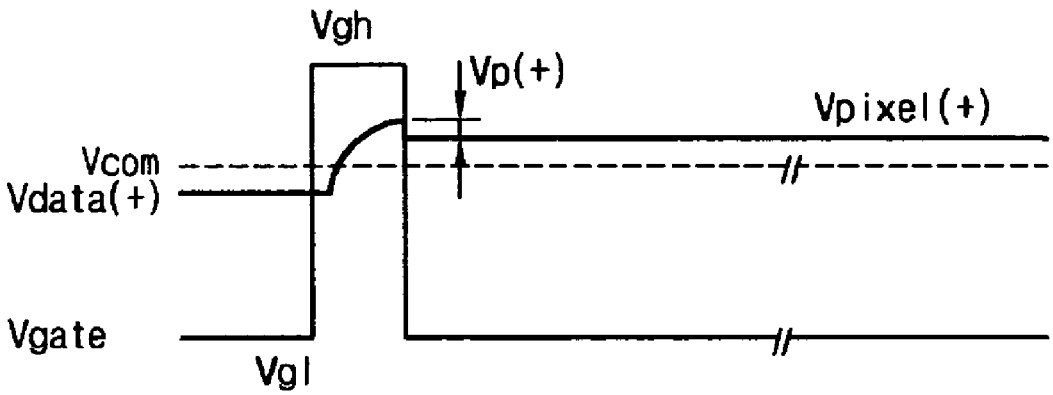
FIGS. 2A and 2B are waveform diagrams showing properties of pixel charge/discharge of the conventional LCD.
Figure 2B:
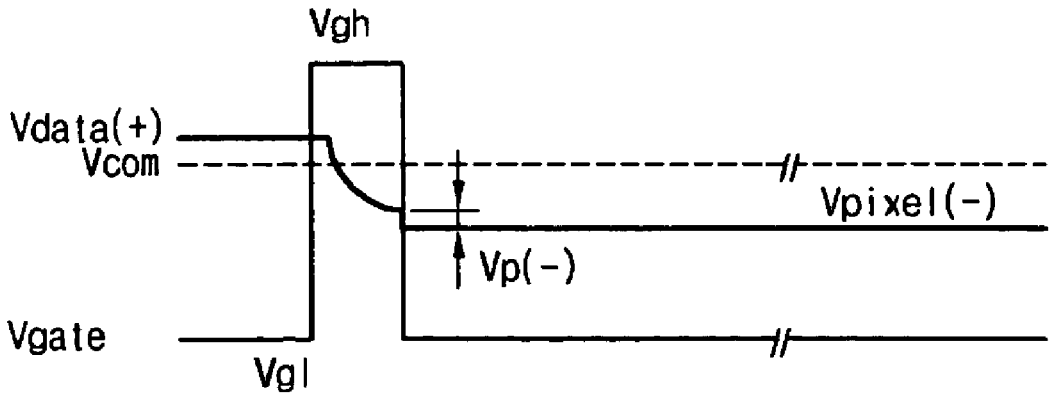

Hereinafter, a preferred embodiment of the present invention will be described with reference to the accompanying drawings. In the following description and drawings, the same reference numerals are used to designate the same or similar components, and so repetition of the description of the same or similar components will be omitted.

Figure 3:
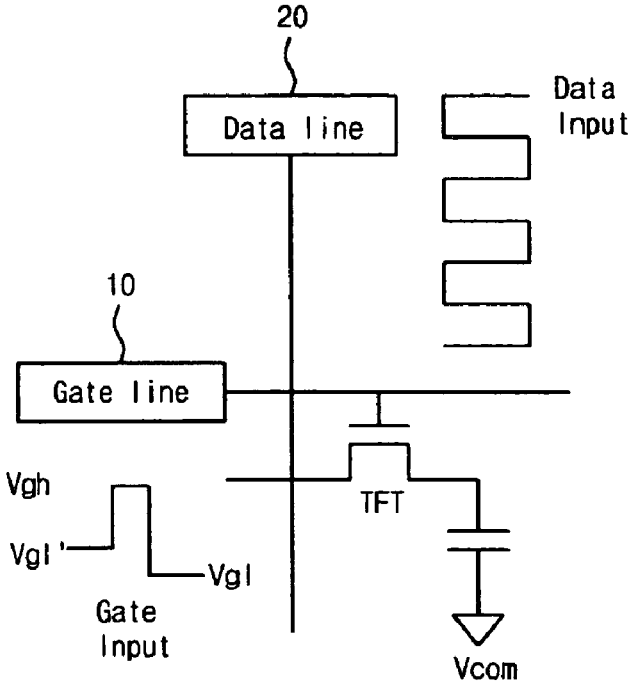
FIG. 3 is a view for explaining a driving method of an LCD according to the present invention.

FIG. 3 is a view for explaining a driving method of an LCD according to the present invention, in which only one pixel is shown for easy understanding of the present invention.

Referring to FIG. 3, an AM-LCD comprises a gate line 10 for applying gate pulse voltage, a data line 20 intersecting the gate line 10 for applying pixel voltage, and a thin film transistor (TFT) arranged in a matrix form at the intersecting region of the gate line 10 and the data line 20. In order to drive an AM-LCD, gate pulse voltages as a gate input are generated in which $1^{st}$, $2^{nd}$ and $3^{rd}$ levels (Vgh, Vgl and Vgl') are provided, and data voltage as a data input is applied to the gate line 10.

According to the present invention, the $3^{rd}$ level Vgl' preferably exists in a range of the $1^{st}$ level Vgh and the $2^{nd}$ level Vgl.

Figure 4:
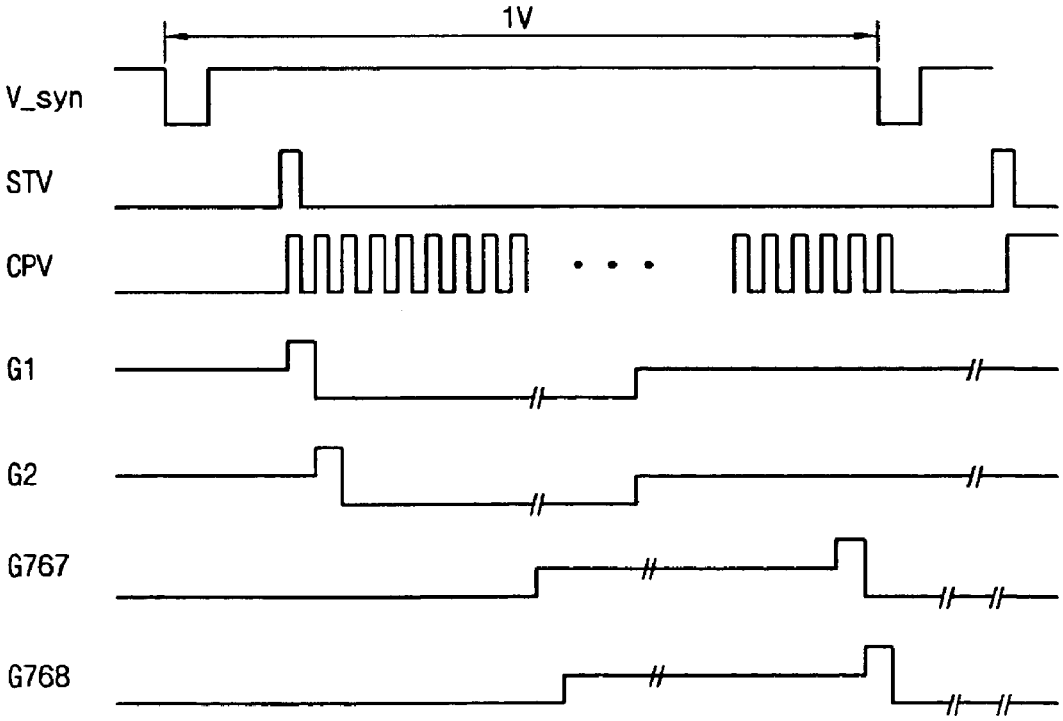
FIG. 4 is a timing diagram for explaining a driving method of an LCD according to the present invention.

FIG. 4 is a timing diagram for explaining a driving method of an LCD according to the present invention.

In the driving method of the present invention, vertical start signals STV are enabled in 1 vertical period 1V (1V corresponds to 16.7 ms when driven at 60 Hz), are synchronized with a transition of vertical clock signal CPV, generating gate pulse voltage having a first, second and third levels Vgl, Vgh and Vgl', thus sequentially scanning the plural gate lines. Herein, V_syn is vertical synchronous signal and G1~G768 are drive signals sequentially applied to from $1^{st}$ gate line to $768^{th}$ gate line.

Meanwhile, in order to drive an LCD in a positive field, the period from generation point of gate pulse signal to point where pixel voltage converges the level of common voltage is divided into a charge period, a holding period and a discharge period, and gate pulse voltage with the $1^{st}$ to $3^{rd}$ levels Vgh, Vgl and Vgl' is generated corresponding to the respective periods.

Meanwhile, in order to drive an LCD in a negative field, the period from generation point of gate pulse signal to point where pixel voltage converges the level of common voltage is divided into a charge period, a holding period and a discharge period, and gate pulse voltage with the $1^{st}$ to $3^{rd}$ levels Vgh, Vgl and Vgl' is generated corresponding to the respective periods.

Figure 5:
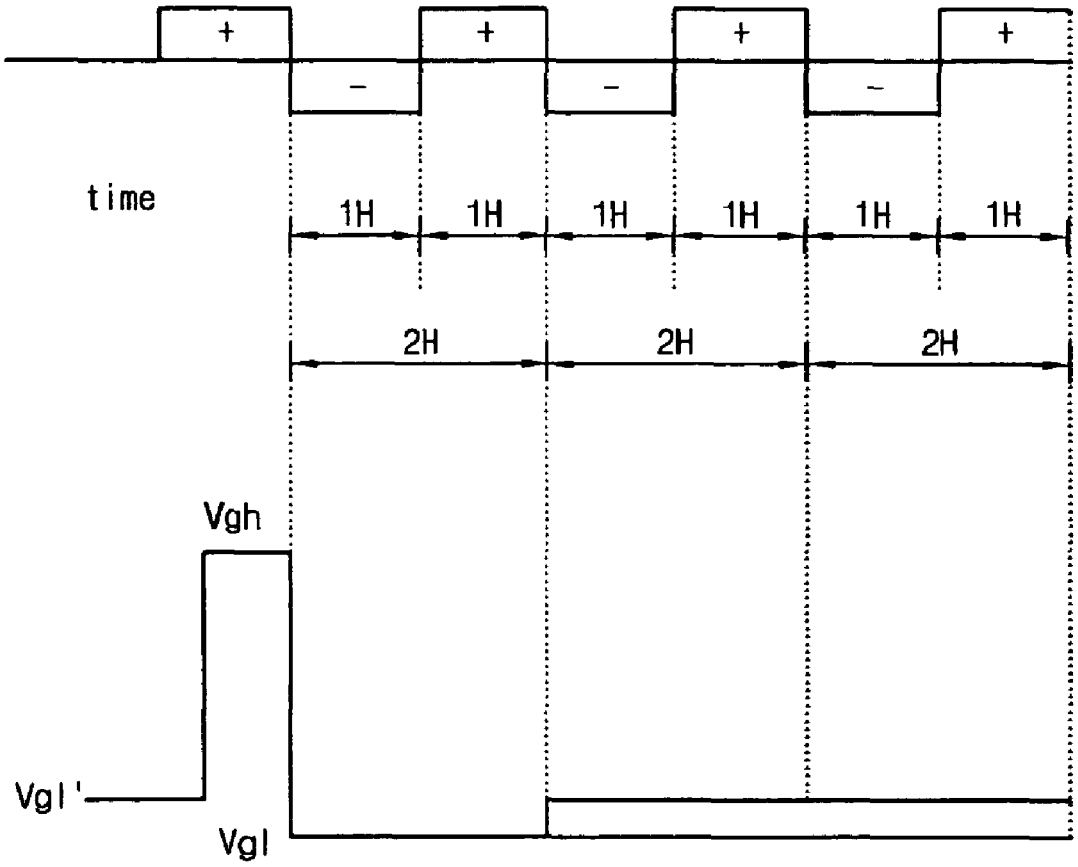
FIG. 5 is a timing diagram showing relationship between gate pulse voltage and data voltage according to the present invention.

FIG. 5 is a timing diagram showing a relationship between gate pulse voltage and data voltage according to the present invention.

As shown in FIG. 5, when the polarity of data voltage is changed, since gate pulse voltage can converge common voltage effectively if the $2^{nd}$ level of gate pulse voltage Vgl is changed into the $3^{rd}$ level of gate pulse voltage Vgl' after 2n*1H after input of the $1^{st}$ level of gate pulse voltage Vgh, adapting timing of the $3^{rd}$ level of gate pulse voltage Vgl' is preferably limited such as 't1=1V−1H−t0=2n*1H, where 0 is positive integer'. That is to say, the holding period of gate pulse voltage preferably maintains 2H.

Figure 6A:
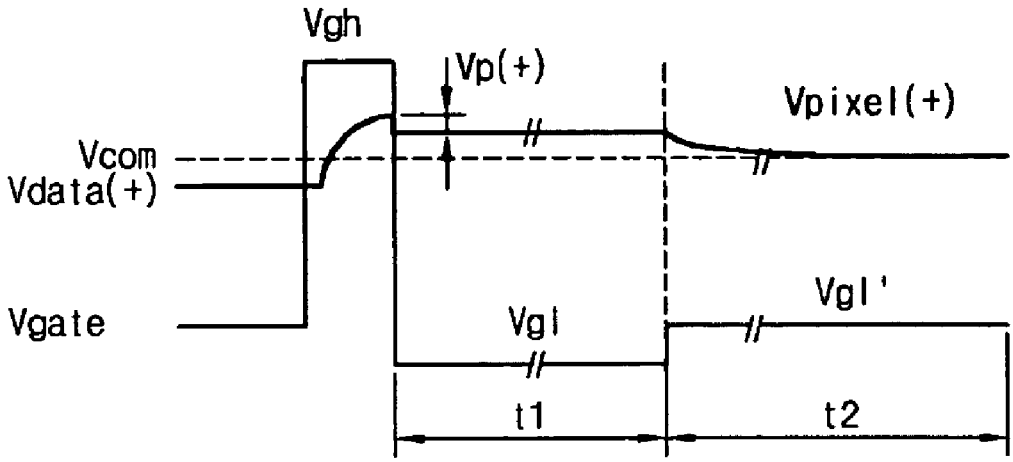
FIGS. 6A and 6B are waveform diagrams showing properties of pixel charge/discharge of an LCD according to the present invention.
Figure 6B:
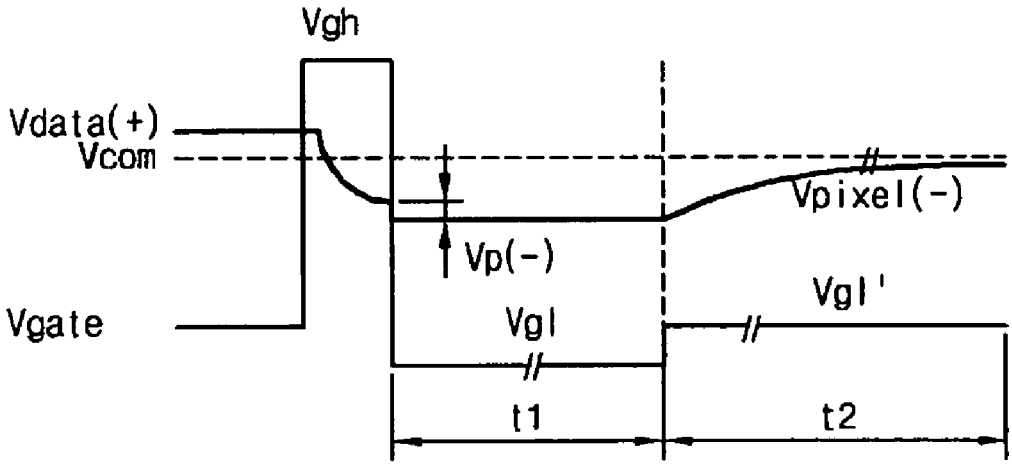

FIGS. 6A and 6B are the diagrams of waveforms on properties of pixel charge/discharge of an LCD according to the present invention, in which FIG. 6A shows the features of pixel charge/discharge in the positive field and FIG. 6B shows the features of pixel charge/discharge in the negative field.

The driving method of the present invention in the positive field is now described with reference to FIG. 6A.

First, if the first level Vgh of gate pulse voltage is generated at a gate drive IC, channels of TFT are opened in a period in which the first level Vgh is maintained. At this point, when data voltage Vdata(+) is applied at a source drive IC, a pixel electrode has an increased charge level while electric charges are introduced into the pixel electrode, charging the electrode in a charge period in which the first level Vgh is maintained.

At this state, when gate pulse voltage is transited from the first level Vgh to the second level Vgl, pixel voltage is reduced by kickback voltage Vp(+) and thus maintained constantly in the holding period. Herein, the holding period provided is preferably shorter than the conventional type.

Second, when the third level Vgl' of gate pulse voltage is generated after maintaining a certain holding period, channels of TFT are opened again, electric charges introduced into the pixel are escaped, so that pixel voltage Vpixel(+) converges the level of common voltage. Herein, the discharge period is preferably set to a range higher than 1 horizontal period 1H but lower than 1 vertical period 1V.

Herein, transition point of the third level Vgl' of gate pulse voltage is set according to a response time of the liquid crystal, i.e., rising time and falling time of the liquid crystal. According to an embodiment of the present invention, the rising time of the liquid crystal is above 10 ms and the falling time of the liquid crystal is below 5 ms.

Meanwhile, according to an embodiment of the present invention, if the holding period is t1 and the discharge period is t2, the holding period t1 equals 1H−1V−t2.

The driving method of the present invention in the negative field is now described with reference to FIG. 6B.

First, if the first level Vgh of gate pulse voltage is generated at a gate drive IC, channels of TFT are opened in a period in which the first level Vgh is maintained. At this point, when data voltage Vdata(+) is applied at a source drive IC, a pixel electrode has an increased charge level while electric charges are introduced into the pixel electrode, charging the electrode in a charge period in which the first level Vgh is maintained.

At this state, when gate pulse voltage is transited from the first level Vgh to the second level Vgl, pixel voltage is reduced by kickback voltage Vp(+) and thus maintained constantly in the holding period. Herein, the holding period provided is preferably shorter than the conventional type.

Second, when the third level Vgl' of gate pulse voltage is generated after maintaining a certain holding period, channels of TFT are opened again, electric charges are introduced into the pixel electrode, so that pixel voltage Vpixel(−) converges the level of common voltage Vcom. Herein, the discharge period is preferably set to a range, which is higher than 1 horizontal period 1H but is lower than 1 vertical period 1V like in the positive period.

Herein, transition point of the third level Vgl' of gate pulse voltage is set according to a response time of the liquid crystal, i.e., rising time and falling time of the liquid crystal. According to an embodiment of the present invention, the rising time of the liquid crystal is above 10 ms and the falling time of the liquid crystal is below 5 ms.

Thus, when pixel voltage converges into common voltage, liquid crystal is in a state of free decay during this period, so that data in the pixel is held during the holding period and is changed into black in the converging period by charge/discharge. This means that it is transformed into a normally black mode, reducing response time and thus obtaining picture quality similar to a pulse type. Also, this generates an effect that the change of the picture image locked up upon conversion of a frame is unlocked in the middle of the frame.

Meanwhile, data outputted in each frame converge into a black state after outputting desired video data, and then data of the next frame are outputted and converge into the black state. Accordingly, the present invention can solve problems in picture image processing due to transition between data, such as slow response speed due to the transition into a middle gray level, securing of time for response speed of the liquid crystal after holding, etc.

Also, since pixel voltage converges into Vcom at every frame transition due to the driving of the gate drive IC, fewer electric charges are required in charging or discharging the pixel electrode, thus reducing the quantity of electric charge required to output the source drive IC.

In the driving method of gate pulse voltage according to the present invention as described above, pixel voltage converges into the level of common voltage in each vertical period, so as to reduce generation of stepping phenomenon, blurring phenomenon, and afterimages, thereby enabling effective realization of moving pictures.

Further, the quantity of electric charge is reduced so that power consumption is reduced. Accordingly, capacitance between the gate and the source generated by overlapping of the TFT gate line and data line is reduced, thus preventing degradation of display property due to the coupling.

Although preferred embodiments of the present invention have been described for illustrative purposes, those skilled in the art will appreciate that various modifications, additions and substitutions are possible, without departing from the scope and spirit of the invention as disclosed in the accompanying claims.

What is claimed is:

1. A method for driving an LCD in which gate lines are sequentially scanned in 1 vertical period, the method comprising the steps of:

sequentially generating a plurality of gate pulse voltages having 1st to 3rd levels while being synchronized with vertical clock signal in said 1 vertical period;

in invert driving, dividing the generating period of the plural gate pulse voltages into a charge period, a holding period and a discharge period in respective polar periods corresponding to the 1st to 3rd levels of the plural gate pulse voltage; and converging pixel voltage of the discharge period to a common voltage level, wherein the 3rd level exists in a range between the 1st level and the $2^{nd}$ level and wherein the transition voltage of the $3^{rd}$ level is selected according to the rise time and fall time of the liquid crystal.

2. A method for driving an LCD as claimed in claim 1, wherein the rising time of the $3^{rd}$ level of the liquid crystal is smaller than the falling time of the $3^{rd}$ level of the liquid crystal.

3. A method for driving an LCD as claimed in claim 1, wherein the holding period is set as more than 2 horizontal periods.

4. A method for driving an LCD as claimed in claim 1, wherein the rise time of the liquid crystal is above 10 ms. and the fall time is below 5 ms.

5. A method for driving an LCD as claimed in claim 1, wherein the discharge period is more than 1 horizontal period 1 H but less than 1 vertical period 1V.

6. A method for driving an LCD as claimed in claim 1, wherein the holding period is substantially equal to the duration of one horizontal period 1 H minus the duration of one vertical period 1V minus duration of the discharge period $t_2$.

7. A method for driving an LCD as claimed in claim 1, wherein the pixel voltage converges to the common voltage level in every frame.

8. A method for driving an LCD as claimed in claim 7, wherein a pixel is held during the holding period and wherein the pixel changes to black during the charge period and during the discharge period.

* * * * *